US007375696B2

(12) United States Patent
Sato et al.

(10) Patent No.: US 7,375,696 B2
(45) Date of Patent: May 20, 2008

(54) ELECTROMAGNETIC WAVE TRANSMITTING/RECEIVING DEVICE

(75) Inventors: Akinobu Sato, Soka (JP); Akiko Suzuki, Akishima (JP); Emmanuel Bourelle, Tachikawa (JP)

(73) Assignee: Japan Aviation Electronics Industry Limited, Tokyo (JP)

( * ) Notice: Subject to any disclaimer, the term of this patent is extended or adjusted under 35 U.S.C. 154(b) by 0 days.

(21) Appl. No.: 11/155,728

(22) Filed: Jun. 16, 2005

(65) Prior Publication Data

US 2006/0017636 A1 Jan. 26, 2006

(30) Foreign Application Priority Data

Jul. 12, 2004 (JP) ..... 2004-204429

(51) Int. Cl.
*H01Q 15/02* (2006.01)
*H01Q 19/06* (2006.01)

(52) U.S. Cl. ..... 343/753; 343/767; 343/909

(58) Field of Classification Search ..... 343/700 MS, 343/753, 754, 767, 785, 909
See application file for complete search history.

(56) References Cited

U.S. PATENT DOCUMENTS 3,795,434 A * 3/1974 Ash ..... 385/129
4,689,584 A * 8/1987 Sequeira ..... 333/1.1
6,037,904 A * 3/2000 Cheng et al. ..... 343/700 MS

FOREIGN PATENT DOCUMENTS

JP 63-500698 3/1988
JP 05-206708 8/1993
JP 08-136647 5/1996
JP 2648421 5/1997
JP 2000-505992 5/2000
JP 2000-174547 6/2000
JP 2001-077624 3/2001
JP 2001-144526 5/2001
JP 2001-156535 6/2001
JP 2001-196841 7/2001

* cited by examiner

*Primary Examiner*—Michael C. Wimer
(74) *Attorney, Agent, or Firm*—David N. Lathrop, Esq.; Gallagher & Lathrop

(57) ABSTRACT

A direction-change element for changing the direction of travel of an incident electromagnetic wave and electromagnetic wave transmitting/receiving elements are disposed on a substrate. The direction-change element has a periodic array of materials of different refractive indexes arranged in parallel to the substrate surface. The electromagnetic wave transmitting/receiving elements are positioned at opposite ends of the periodic array in the direction of its arrangement. The output ratio between the two electromagnetic wave transmitting/receiving elements can be used to detect the incidence angle of the electromagnetic wave with high accuracy. By changing the relative intensity of electromagnetic waves to be sent from the two electromagnetic wave transmitting/receiving elements, it is possible to achieve high-accuracy control of the angle of emittance of the electromagnetic wave to be sent from the device. Accordingly, the present invention offers a small, low-profile electromagnetic wave transmitting/receiving device capable of detecting and radiating electromagnetic waves with high accuracy of their incidence and emittance angles.

20 Claims, 4 Drawing Sheets

ELECTROMAGNETIC WAVE TRANSMITTING/RECEIVING DEVICE

BACKGROUND OF THE INVENTION

The present invention relates generally to a device for transmitting and receiving light, radio wave or similar electromagnetic waves and, more particularly, to an electromagnetic wave transmitting/receiving device that detects or radiates electromagnetic waves with a high degree of accuracy in their angle of incidence and emittance.

In an electromagnetic sensor or antenna it is an important problem to accurately control the direction of electromagnetic waves.

Conventionally, a dielectric lens is used to control the directivity of electromagnetic waves. A dielectric lens antenna using such a dielectric lens is described in Japanese Patent Application Kokai Publication No. 2000-174547 (published Jun. 23, 2000, hereinafter referred to as document 1). In the dielectric lens antenna disclosed in document 1 the dielectric constant of a dielectric member, which is disposed between the dielectric lens and the primary radiator to integrate them into a single structural member, is gradually reduced, for instance, toward radially outer side of the dielectric lens with a view to achieving high efficiency and sliming down of the antenna. On the other hand, in Japanese Patent No. 2768439 (issued Jun. 25, 1998, hereinafter referred to as document 2) there is set forth a method for detecting electromagnetic waves of low directivity over a wide angle range by a plurality of directional antennas placed in different directions.

The dielectric lens antenna disclosed in document 1 can be slimmed down as compared with those used in the past, but the bulkiness of the dielectric lens itself imposes limitations on the sliming down of the antenna structure, and the detection of the angle of electromagnetic waves generally calls for arrangement of a plurality of dielectric lenses; for these reasons, slimming down or miniaturization of the dielectric lens antenna is hard to realize.

With the structure using a plurality of directional antennas as set forth in document 2, enhancement of the accuracy of angle detection of electromagnetic waves requires arrangement of a large number of antennas, and hence miniaturization is difficult to achieve.

SUMMARY OF THE INVENTION

It is therefore an object of the present invention to provide an electromagnetic wave transmitting/receiving device for transmitting and receiving electromagnetic waves such as light or radio waves, which can be extremely slimmed down and miniaturized and is so adapted as to detect and radiate electromagnetic waves with a high degree of accuracy in their angle of incidence and emittance.

According to the present invention, there is provided an electromagnetic wave transmitting/receiving device wherein:

a direction-change element for changing the direction of travel of an electromagnetic wave and electromagnetic wave transmitting/receiving elements are disposed on a substrate;

said direction-change element has a structure of a periodic array of materials of different refractive indexes arranged in parallel to the top surface of said substrate; and said electromagnetic wave transmitting/receiving elements are disposed at opposite ends of said periodic array in the direction of arrangement of said array.

With the above device configuration, the electromagnetic wave transmitting/receiving device according to the present invention is capable of detecting the incidence angle of the electromagnetic wave with high accuracy during reception of the electromagnetic wave through utilization of the output ratio between the electromagnetic wave transmitting/receiving elements disposed at opposite ends of the direction-change element in the direction of the periodic array; during transmission of an electromagnetic wave from the device its emittance angle can be controlled with high accuracy by changing the relative intensity of electromagnetic waves to be sent from the electromagnetic wave transmitting/receiving elements. Hence, the device of the present invention permits detection and radiation of electromagnetic waves with a high degree of accuracy in their incidence and emittance angles.

Since the direction-change element and the electromagnetic wave transmitting/receiving elements are disposed side by side on the same substrate surface, the electromagnetic wave transmitting/receiving device of the present invention can be miniaturized and more particularly low-profile as compared with conventional electromagnetic wave transmitting/receiving devices using a dielectric lens or the like. Accordingly, the electromagnetic wave transmitting/receiving device of the present invention is suitable for use as a position sensor or communication device such as a millimeter wave radar or infrared sensor.

DESCRIPTION OF THE PREFERRED EMBODIMENTS

A description will be given below of embodiments of the present invention.

EMBODIMENT 1

Figure 1A:
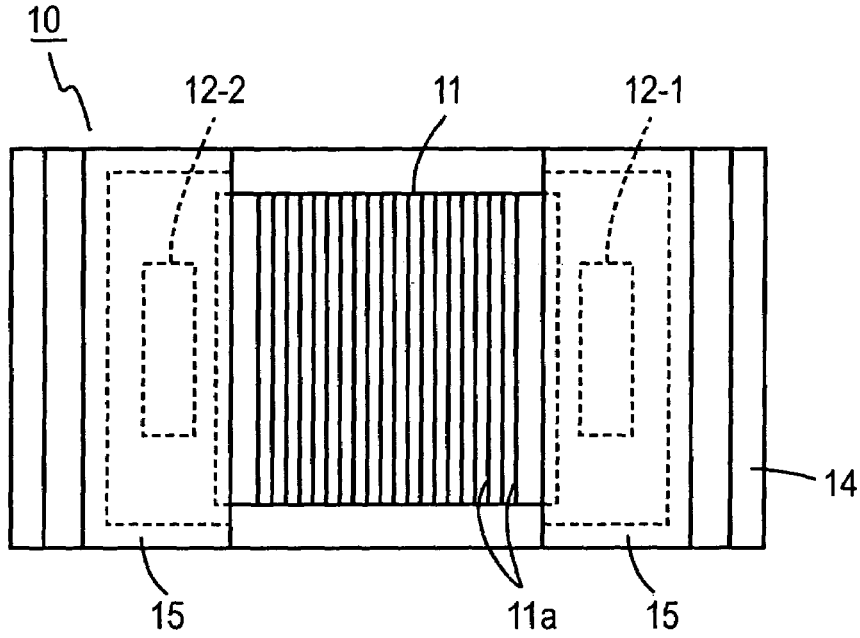
FIG. 1A is a plan view illustrating an electromagnetic wave transmitting/receiving device according to a first embodiment of the present invention.
Figure 1B:
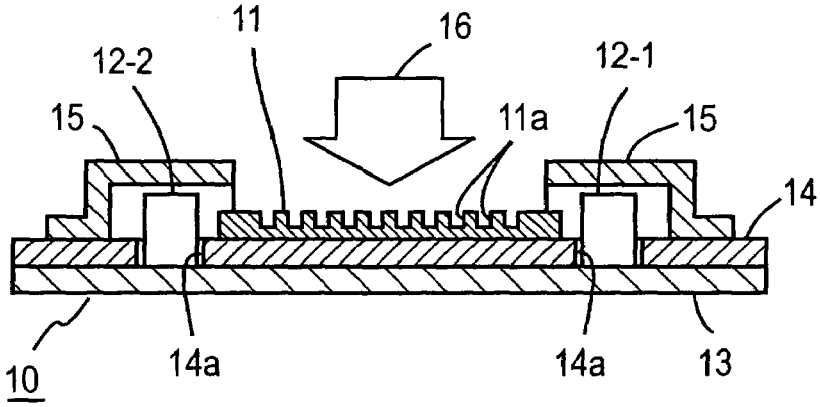
FIG. 1B is a sectional view of the electromagnetic wave transmitting/receiving device shown in FIG. 1A.

FIGS. 1A and 1B schematically illustrate a first embodiment of the electromagnetic wave transmitting wave/receiving device according to the present invention. The electromagnetic wave transmitting/receiving device, denoted generally by 10, is provided with a direction-change element 11 and two electromagnetic wave transmitting/receiving elements 12-1 and 12-2 arranged side by side on a substrate 13.

The substrate 13 is, in this example, a 1-mm thick silicon (Si) substrate, the top of which is covered with a 1-mm thick glass plate 14 bonded thereto, the direction-change element 11 being mounted on the glass plate 14.

The direction-change element 11 is to change the direction of travel of electromagnetic waves, and it has a periodic array of materials of different refractive indexes arranged in parallel to the surface of the substrate 13; in this example, the direction-change element 11 is a planar optical waveguide with a diffraction grating mounted on the top thereof. The direction-change element 11 is formed using a 800-μm thick plate of silicon, and straight grooves 11*a* forming the diffraction grating are, in this example, cut with a pitch of 2 mm, and each groove is 1 mm wide and 400 μm deep.

Such a direction-change element 11 is made by bonding the 800-μm thick plate of silicon onto the top of the glass plate 14 and then forming the straight grooves 11*a* in the plate of silicon by dieing. By this, a silicon-air periodic array structure is formed.

Figure 1C:
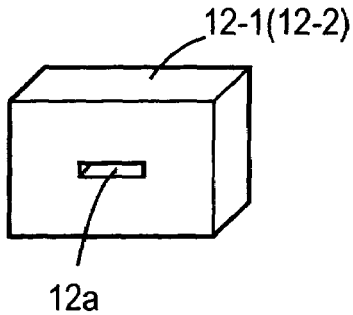
FIG. 1C is a perspective view of an electromagnetic wave transmitting/receiving element in the embodiment of FIGS. 1A and 1B.

The electromagnetic wave transmitting/receiving elements 12-1 and 12-2 are mounted on the substrate 13 in holes 14*a* made in the glass plate 14 at opposite ends of the direction-change element 11 in the direction of arrangement of its silicon-air periodic array; that is, the electromagnetic wave transmitting/receiving elements 12-1 an 12-2 are disposed opposite across the direction-change element 11. The electromagnetic wave transmitting/receiving elements 12-1 and 12-2 in this embodiment are each a slot antenna of such an outside appearance as shown in FIG. 1C. Reference numeral 12*a* denotes a slot. The electromagnetic wave transmitting/receiving elements 12-1 and 12-2 are disposed with their slots 12*a* held opposite both end faces of the direction-change element 11 in the direction of arrangement of its silicon-air periodic array.

The electromagnetic wave transmitting/receiving elements 12-1 and 12-2 are each covered with a shield 15 except the inner side surface of the element facing toward the direction-change element 11. The shields 15 are made of stainless steel, and they are fixedly bonded or screw-held to the glass plate 14.

With the electromagnetic wave transmitting/receiving device 10 of the above-mentioned configuration, the direction of travel of an electromagnetic wave incident on the device as indicated by the arrow 16 is changed by the direction-change element 11 for propagation therethrough in the direction of arrangement of the silicon-air periodic array to the electromagnetic wave transmitting/receiving elements 12-1 and 12-2.

Figure 2:
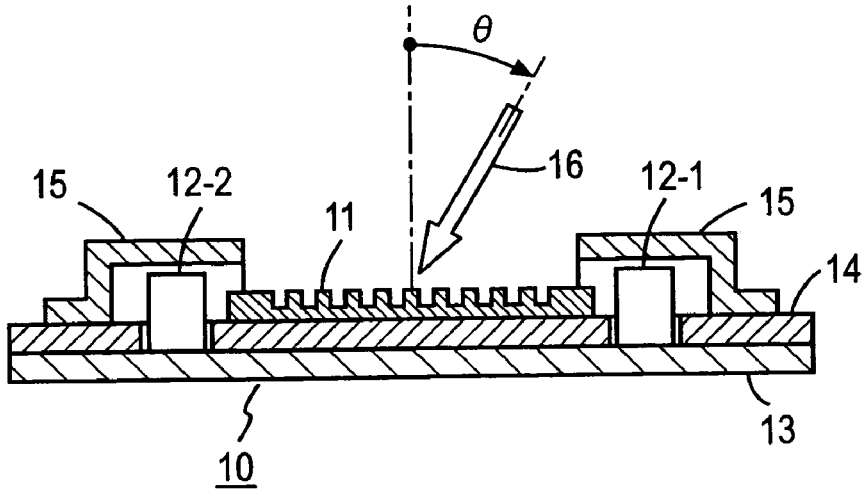
FIG. 2 is a sectional view of the electromagnetic wave transmitting/receiving device of the embodiment of FIGS. 1A and 1B, for explaining the angle of incidence thereto of an electromagnetic wave.

The outputs from the two electromagnetic wave transmitting/receiving elements 12-1 and 12-2 were measured with a 60-GHz electromagnetic wave whose incidence angle θ to the electromagnetic wave transmitting/receiving device 10 was varied from 0° (incidence vertical to the substrate surface) as shown in FIG. 2.

Figure 3:
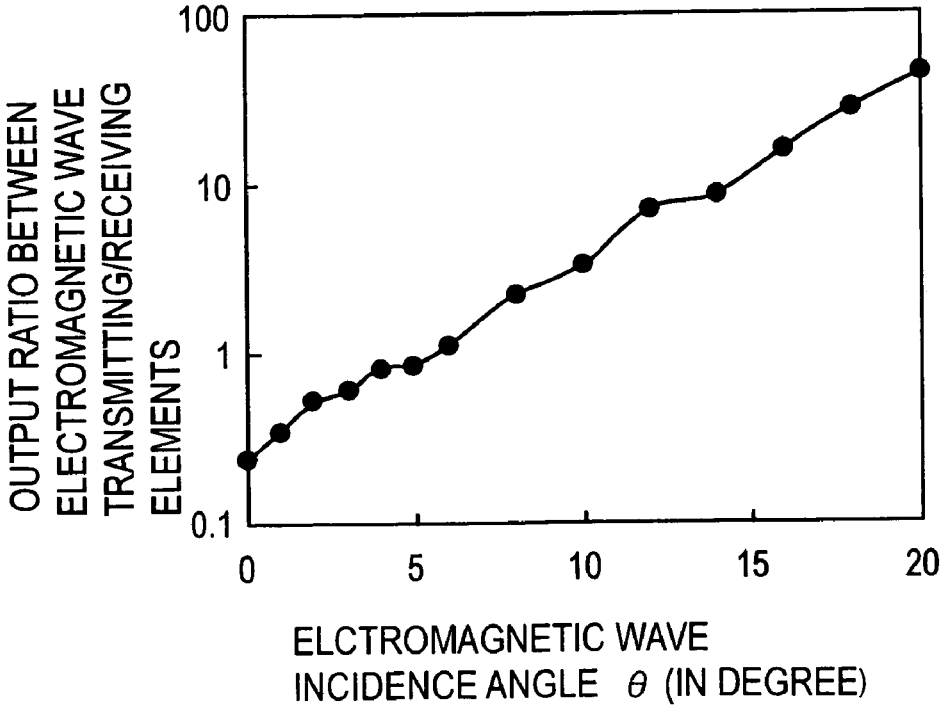
FIG. 3 is a graph showing the relationship between the incidence angle of the electromagnetic wave and the output ratio between two electromagnetic wave transmitting/receiving elements in the embodiment of FIGS. 1A and 1B.

FIG. 3 shows the measured values. The abscissa represents the incidence angle θ of the electromagnetic wave and the ordinate the output ratio between the electromagnetic wave transmitting/receiving elements 12-1 and 12-2 on a logarithmic scale. When the incidence angle θ is 0°, the output ratio is 0.23, and when the incidence angle θ is 20°, the output ratio is 44.4. FIG. 3 indicates that the output ratio varies linearly with the incidence angle θ, and the rate of change of the output ratio is 1.30 per degree. The rate of change of the output ratio is 1.30 per degree means that, letting b represent the output ratio when the incidence angle θ is a°, the output ratio corresponding to an incidence angle of (a+1)° is 1.30×b. The higher the rate of change of the output ratio with the incidence angle θ, the higher the device sensitivity.

When the direction-change element 11 is bilaterally symmetrical in the direction of arrangement of its silicon-air periodic array, the above-mentioned output ratio (initial value) is 1 ideally when the incidence angle θ is 0°. With an increase in the incidence angle θ, however, the output from at least one of the two electromagnetic wave transmitting/receiving elements 12-1 and 12-2 decreases and the SN ratio drops accordingly. The device sensitivity can be increased over a desired incidence angle range, for example, by forming the direction-change element 11 bilaterally asymmetrical and by offsetting the initial value of the output ratio. This embodiment is intended to implement such a device configuration.

As is evident from the measured values shown in FIG. 3, according to the electromagnetic wave transmitting/receiving device 10 of FIGS. 1A and 1B, the output ratio between the two electromagnetic wave transmitting/receiving elements 12-1 and 12-2 undergoes extremely great changes with the variation in the incidence angle θ of the electromagnetic wave—this permits highly accurate measurement of the incidence angle θ of the electromagnetic wave. The electromagnetic wave transmitting/receiving device 10 has small dimensions of approximately 3 cm (length) by 5 cm (width) by 5 mm (thickness), and hence it can be made particularly low-profile.

While in the above the electromagnetic wave transmitting/receiving device 10 has been described as receiving the electromagnetic wave, a description will be given of the transmission of the electromagnetic wave from the device 10.

A 60-GHz electromagnetic wave was sent from each of the electromagnetic wave transmitting/receiving elements 12-1 and 12-2. The electromagnetic waves sent from the both elements were 180° out of phase with each other. By changing the relative intensity of the electromagnetic waves sent from the both elements 12-1 and 12-2, it was possible to vary the angle of emittance of the electromagnetic wave from the surface of the electromagnetic wave transmitting/receiving device 10, that is, from the top surface of the direction-change element 11.

The relationship of the angle of emittance of the electromagnetic wave to the electromagnetic wave intensity ratio between the elements 12-1 and 12-2 is similar to the relationship between the incidence angle θ of the electromagnetic wave and the output ratio between the element 12-1 and 12-2. Accordingly, the electromagnetic wave transmitting/receiving device 10 permits high-accuracy control of the angle of emittance of the electromagnetic wave.

EMBODIMENT 2

Figure 4:
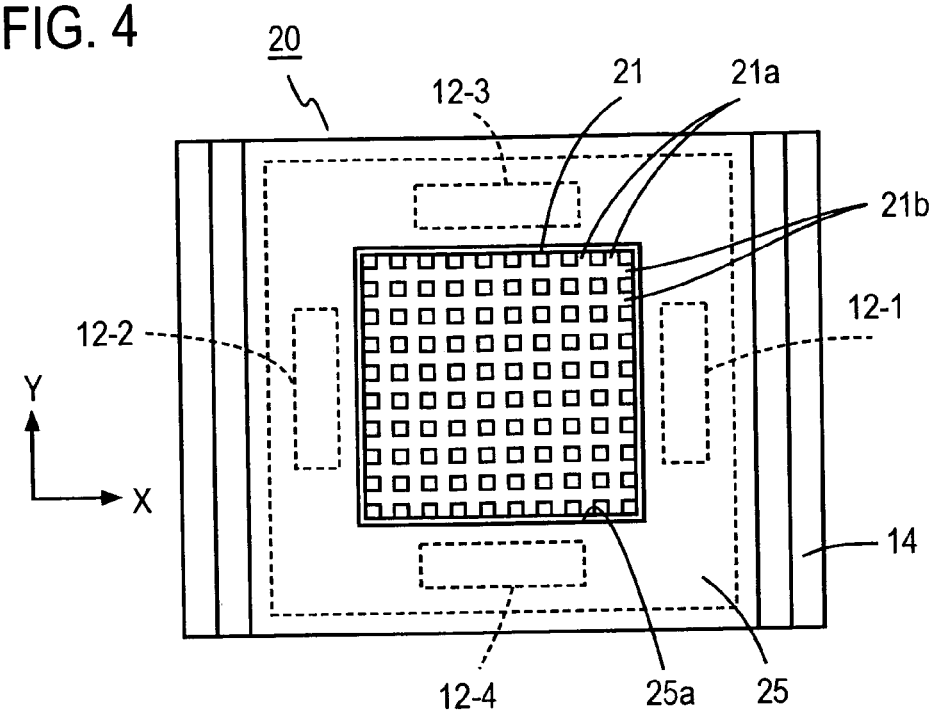
FIG. 4 is a plan view illustrating an electromagnetic wave transmitting/receiving device according to a second embodiment of the present invention.

FIG. 4 illustrates a second embodiment of the present invention, in which the direction-change element, denoted generally by 21, has an array of materials of different refractive indexes in each of two directions crossing at right angles and electromagnetic wave transmitting/receiving elements 12-1 to 12-4 are disposed at opposite ends of the arrays, respectively.

As is the case with the direction-change element 11 in Embodiment 1, the direction-change element 21 is formed using a 800-μm thick plate of silicon, and in this embodiment straight grooves 21*a* and 21*b* are formed by dieing in rows and columns, providing a two-dimensional silicon-air periodic array structure. The straight grooves 21*a* and 21*b* are formed with a pitch of 2 mm, and each groove is 1 mm wide and 400 μm deep.

The substrate 13 (hidden under the glass plate 14 in FIG. 4) and the glass plate 14 are of the same specifications as those in Embodiment 1, and the four electromagnetic wave transmitting/receiving elements 12-1 to 12-4 are slot antennas as in Embodiment 1. The electromagnetic wave transmitting/receiving elements 12-1 to 12-4 are covered with a single-piece shield 25 made of stainless steel. Reference numeral 25*a* denotes an opening made in the top of the shield 25.

With the electromagnetic wave transmitting/receiving device 20 of the above configuration, it is possible to detect the incidence angle of electromagnetic waves with high accuracy in the two orthogonal directions during reception and to control the emittance angle of electromagnetic waves with high accuracy in the two orthogonal directions during transmission.

As is the case with Embodiment 1, the outputs from the electromagnetic wave transmitting/receiving elements 12-1 to 12-4 were measured with a 60-GHz electromagnetic wave applied to the device 20 at varying degrees of the incidence angle θ thereto.

The rate of change of the output ratio between the electromagnetic wave transmitting/receiving elements 12-1 and 12-2 to the incidence angle θ varied in the X-direction in FIG. 4 was 1.12 per degree. The rate of change of the output ratio between the electromagnetic wave transmitting/receiving elements 12-3 and 12-4 to the incidence angle θ varied in the Y-direction was 1.09 per degree.

EMBODIMENT 3

Figure 5A:
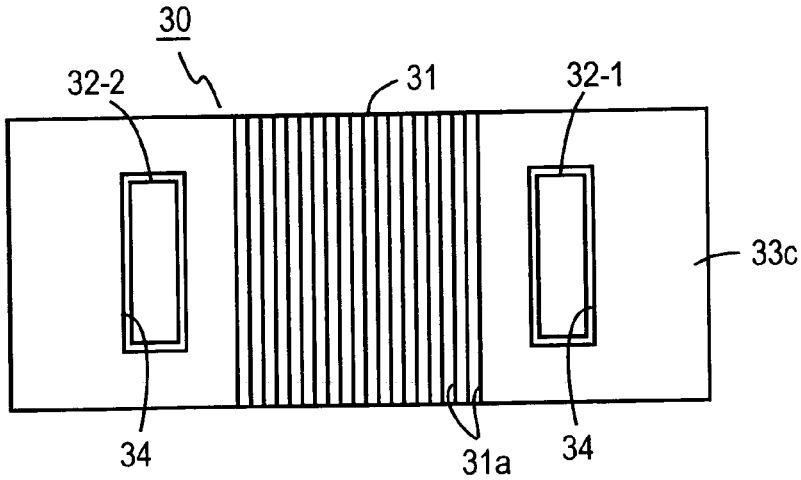
FIG. 5A is a plan view illustrating an electromagnetic wave transmitting/receiving device according to a third embodiment of the present invention.
Figure 5B:
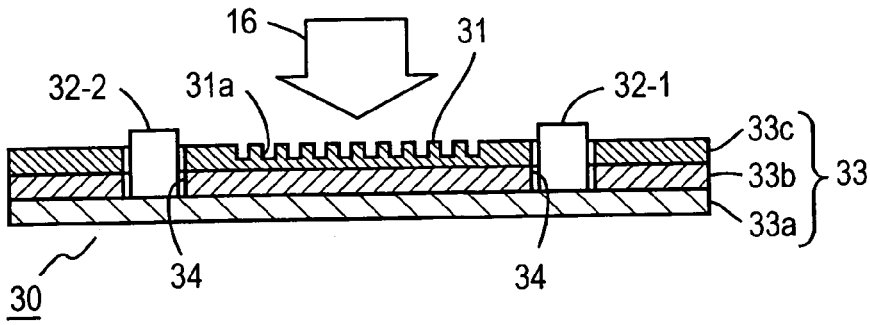
FIG. 5B is a sectional view of the electromagnetic wave transmitting/receiving device shown in FIG. 5A.

FIGS. 5A and 5B illustrate a third embodiment of the present invention, which uses a three-layered SOI (Silicon on Insulator) substrate 33 having a silicon layer 33*c* deposited all over a silicon substrate 33*a* with an insulating layer 33*b* sandwiched therebetween. The insulating layer 33*b* formed by a $SiO_2$ film is 1 μm thick.

The direction-change element, denoted generally by 31, is formed by selective etching of the silicon layer 33*c*. The direction-change element 31 has, as is the case with the counterpart in Embodiment 1, a silicon-air periodic array structure formed by straight grooves 31*a* in one direction.

The direction-change element 31 is formed by: coating the silicon layer 33*c* with a resist; performing so-called line-and-space patterning of the resist; forming the straight grooves 31*a* by dry etching in the silicon layer 33*c* through the resist used as a mask; and removing the resist. The straight grooves 31*a* are spaced 0.58 μm apart, and they are each 0.29 μm wide and 0.1 μm deep.

The electromagnetic wave transmitting/receiving elements, denoted by 32-1 and 32-2, respectively, are disposed on the silicon substrate 33*a* in holes 34 bored through the silicon layer 33*c* and the insulating layer 33*b*; the elements 32-1 and 32-2 are located at opposite ends of the direction-change element 31 in the direction of its silicon-air periodic array. The electromagnetic wave transmitting/receiving elements 32-1 and 32-2 are photodiodes in this embodiment.

As is the case with Embodiment 1, the outputs from the electromagnetic wave transmitting/receiving elements 32-1 and 32-2 were measured with an electromagnetic wave of a 1.5-μm wavelength applied to the device 30 at varying degrees of the incidence angle θ thereto. The measured values were substantially equal to those shown in FIG. 3, and the rate of change of the output ratio between the electromagnetic wave transmitting/receiving elements 32-1 and 32-2 to the incidence angle θ was 1.26 per degree.

COMPARATIVE EXAMPLE 1

The electromagnetic wave transmitting/receiving device used for comparison was identical in configuration with the device of Embodiment 1 except that the former was provided with only one electromagnetic wave transmitting/receiving element. The output from the electromagnetic wave transmitting/receiving element was measured with a 60-GHz electromagnetic wave applied thereto at varying degrees of the incidence angle θ as in the case of Embodiment 1.

Figure 6:
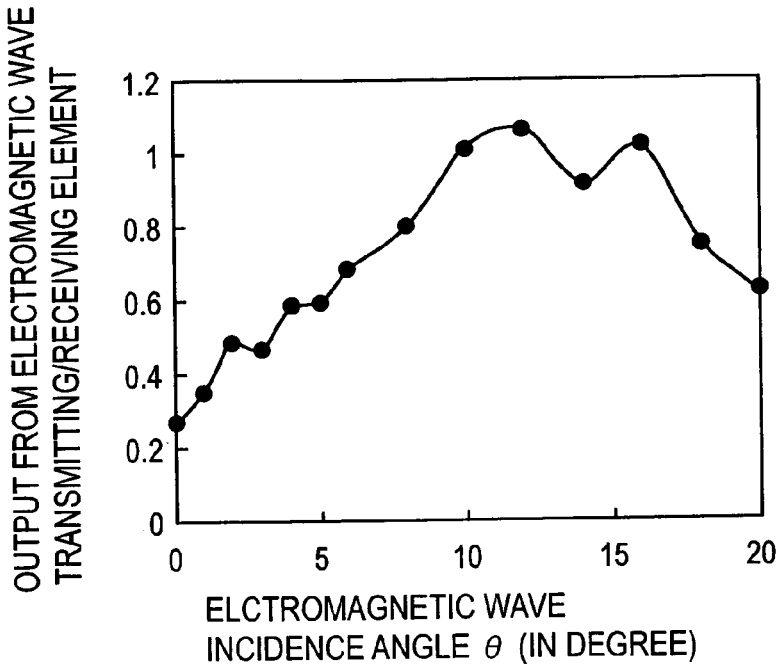
FIG. 6 is a graph showing the relationship between the output from an electromagnetic wave transmitting/receiving element and the incidence angle of an electromagnetic wave in an electromagnetic wave transmitting/receiving device identical in configuration with that of FIGS. 1A and 1B except the use of only one electromagnetic wave transmitting/receiving element.

FIG. 6 shows the measured values, from which it can be seen that the output changes substantially linearly with the incidence angle θ until the latter reached approximately 10° but not linearly at larger incidence angles. Accordingly, detection of the incidence angle θ is basically impossible. Incidentally, the rate of change in the output within the range of the incidence angle θ from 0° to 10° was 0.073 per degree.

COMPARATIVE EXAMPLE 2

Figure 7A:
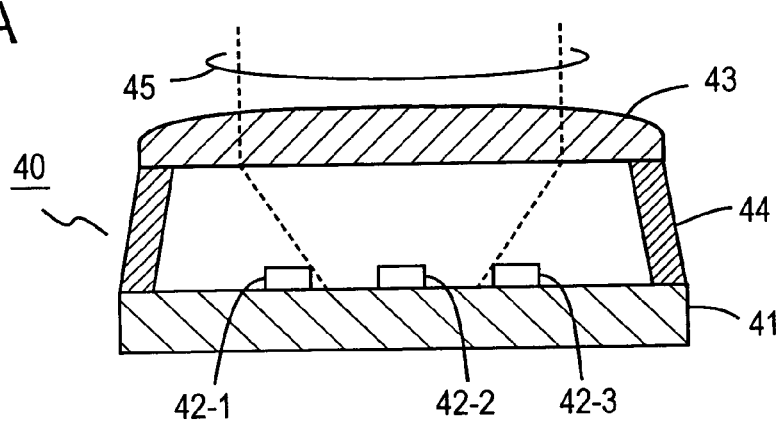
FIG. 7A is a sectional view illustrating the configuration of an electromagnetic wave transmitting/receiving device using a conventional dielectric lens.

FIG. 7A shows, by way of example, the configuration of an electromagnetic wave transmitting/receiving device 40 with a dielectric lens that was used for comparison with the device of the present invention. In this example, three electromagnetic wave transmitting/receiving elements 42-1 to 42-3 are disposed on a glass substrate 41, on which there is mounted a dielectric lens 43 just above the elements 42-1 to 42-3 with a spacer 44 interposed between the substrate 41 and the dielectric lens 43. The dielectric lens 43 is made of alumina and disposed above the electromagnetic wave transmitting/receiving elements 42-1 to 42-3 at a distance of 3 cm in this example. The electromagnetic wave transmitting/receiving elements 42-1 to 42-3 are used as slot antennas.

Figure 7B:
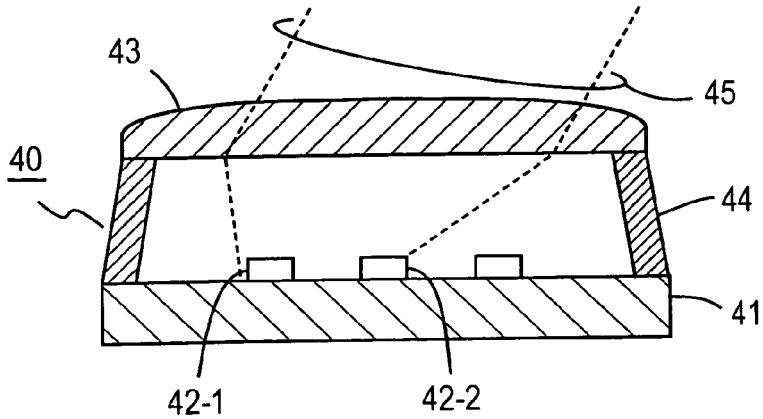
FIG. 7B is a sectional view showing the incidence of electromagnetic waves to the electromagnetic wave transmitting/receiving device of FIG. 7A at an angle thereto.

As in the case of Embodiment 1, the outputs from the electromagnetic wave transmitting/receiving elements 42-1 to 42-3 were measured with a 60-GHz applied to the above-mentioned device 40 at varying degrees of the incidence angle θ thereto. FIG. 7A shows the case in which the incidence angle θ of an electromagnetic wave 45 is 0° and FIG. 7B shows the case in which the electromagnetic wave is incident on the device at some angle thereto.

The rate of change in the output ratio between the electromagnetic wave transmitting/receiving elements 42-1 and 42-2 to the incidence angle θ was 0.27 per degree. The electromagnetic wave transmitting/receiving device 40 had a size of approximately 10 cm by 10 cm and a thickness of about 5 cm.

Comparison between Embodiments 1 to 3 of the present invention and comparative examples 1 to 2 indicates such advantages of the former over the latter as mentioned below.

1) With only one electromagnetic wave transmitting/receiving element provided as in comparative example 1, it is basically impossible to measure the incidence angle of electromagnetic waves with high accuracy; however, according to Embodiments 1 and 2 in which two or more electromagnetic wave transmitting/receiving elements are disposed in opposing relation across the direction-change element and the output ratios (signal ratios) between the opposed pairs of electromagnetic wave transmitting/receiving elements are used, it is possible to measure the incidence angle of electromagnetic waves with a very high degree of accuracy.

2) With the configuration of comparative example 2, since the change in the output ratio between the electromagnetic wave transmitting/receiving elements is so little that high-accuracy measurement of incidence angle is impossible, and the electromagnetic wave transmitting/receiving device is bulky, in particular, large in thickness. In contrast to the above, the configurations of Embodiments 1 to 3 permit high-precision angle measurements and provide small, low-profile electromagnetic wave transmitting/receiving devices.

3) As described previously with reference to Embodiment 1, the device of the present invention can be used to send electromagnetic waves from the electromagnetic wave transmitting/receiving elements, in which case, too, it is possible to effect angle control with high precision.

4) As referred to above with respect to Embodiment 3, no particular limitations are imposed on the wavelength of the electromagnetic wave and on the configuration of the electromagnetic wave transmitting/receiving element; hence, the device of the present invention can be used over a wide wavelength region.

What is claimed is:

1. An electromagnetic wave receiving device comprising:

a direction-change element that changes direction of travel of an incident electromagnetic wave, that is disposed on a substrate, and that comprises a periodic array of semiconductor and dielectric materials having different refractive indexes and being arranged in parallel to a top surface of said substrate, wherein said periodic array is a two-dimensional periodic array in each of two orthogonal directions, and electromagnetic wave receiving transducers that are disposed on the substrate at opposite sides of said two-dimensional periodic array in each of said two orthogonal directions.

2. The device of claim 1, wherein:

said electromagnetic wave receiving transducers comprise slot antennas.

3. The device of claim 1, wherein:

said electromagnetic wave receiving transducers are each covered with a shield except the side surface facing toward said direction-change element.

4. A method for determining an angle of incidence of an electromagnetic wave on an electromagnetic wave receiving device, wherein the method comprises:

receiving the electromagnetic wave through electromagnetic wave receiving transducers that are disposed on a substrate at ends of a direction-change element, wherein the direction-change clement is disposed on the substrate and has a structure of a periodic array of semiconductor and dielectric materials of different refractive indexes arranged in parallel to the top surface of said substrate; and determining the angle of incidence of the electromagnetic wave on said direction-change element in response to a ratio of intensity of electromagnetic waves received through the electromagnetic wave receiving transducers that are disposed at opposite ends of the direction-change element.

5. The method of claim 4, wherein:

said periodic array in said direction-change element is a two-dimensional periodic array in each of two orthogonal directions, and said electromagnetic wave receiving transducers are disposed at opposite sides of said two-dimensional periodic array in each of said two orthogonal directions.

6. The method of claim 4, wherein said direction-change element is a planar optical waveguide provided with a diffraction grating.

7. The method of claim 4, wherein said electromagnetic wave receiving transducers comprise slot antennas.

8. The method of claim 4, wherein said electromagnetic wave receiving transducers are each covered with a shield except for a side surface of said electromagnetic wave receiving transducers that face toward said direction-change element.

9. A method for controlling an angle of emission of an electromagnetic wave from an electromagnetic wave transmitting device, wherein the method comprises:

transmitting the electromagnetic wave through electromagnetic wave transmitting transducers that are disposed on a substrate at ends of a direction-change element, wherein the direction-change element is disposed on the substrate and has a structure of a periodic array of semiconductor and dielectric materials of different refractive indexes arranged in parallel to the top surface of said substrate; and controlling the angle of emission of the electromagnetic wave from said direction-change element in response to a ratio of intensity of electromagnetic waves emitted from the electromagnetic wave transmitting elements that are disposed at opposite ends of the direction-change element.

10. The method of claim 9, wherein:

said periodic array in said direction-change element is a two-dimensional periodic array in each of two orthogonal directions, and said electromagnetic wave transmitting transducers are disposed at opposite sides of said two-dimensional periodic array in each of said two orthogonal directions.

11. The method of claim 9, wherein said direction-change element is a planar optical waveguide provided with a diffraction grating.

12. The method of claim 9, wherein said electromagnetic wave transmitting transducers comprise slot antennas.

13. The method of claim 9, wherein said electromagnetic wave transmitting transducers are each covered with a shield except for a side surface of said electromagnetic wave transmitting transducers that face toward said direction-change element.

14. An electromagnetic wave transmitting device comprising:

a direction-change element that changes direction of travel of an incident electromagnetic wave, that is disposed on a substrate, and that comprises a periodic array of semiconductor and dielectric materials having different refractive indexes and being arranged in parallel to a top surface of said substrate, wherein said periodic array is a two-dimensional periodic array in each of two orthogonal directions, and electromagnetic wave transmitting transducers that are disposed on the substrate at opposite sides of said two-dimensional periodic array in each of said two orthogonal directions.

15. The device of claim 14, wherein:

said electromagnetic wave transmitting transducers comprise slot antennas.

16. The device of claim 14, wherein:

said electromagnetic wave transmitting transducers are each covered with a shield except the side surface facing toward said direction-change element.

17. An electromagnetic wave receiving device that comprises:

a direction-change element that changes direction of travel of an incident electromagnetic wave, that is disposed on a substrate, and that comprises a periodic array of semiconductor and dielectric materials having different refractive indexes and being arranged in parallel to a top surface of said substrate; and electromagnetic wave receiving transducers that are disposed on the substrate at opposite ends of said periodic array in the direction of its arrangement and comprise slot antennas.

18. An electromagnetic wave receiving device that comprises:

a direction-change element that changes direction of travel of an incident electromagnetic wave, that is disposed on a substrate, and that comprises a periodic array of semiconductor and dielectric materials having different refractive indexes and being arranged in parallel to a top surface of said substrate; and electromagnetic wave receiving transducers that are disposed on the substrate at opposite ends of said periodic array in the direction of its arrangement and are each covered with a shield except the side surface facing toward said direction-change element.

19. An electromagnetic wave transmitting device that comprises:

a direction-change element that changes direction of travel of an incident electromagnetic wave, that is disposed on a substrate, and that comprises a periodic array of semiconductor and dielectric materials having different refractive indexes and being arranged in parallel to a top surface of said substrate; and electromagnetic wave transmitting transducers that are disposed on the substrate at opposite ends of said periodic array in the direction of its arrangement and comprise slot antennas.

20. An electromagnetic wave transmitting device that comprises:

a direction-change element that changes direction of travel of an incident electromagnetic wave, that is disposed on a substrate, and that comprises a periodic array of semiconductor and dielectric materials having different refractive indexes and being arranged in parallel to a top surface of said substrate; and electromagnetic wave transmitting transducers that are disposed on the substrate at opposite ends of said periodic array in the direction of its arrangement and are each covered with a shield except the side surface facing toward said direction-change element.

* * * * *